US010128602B2

(12) United States Patent
Glick et al.

(10) Patent No.: US 10,128,602 B2
(45) Date of Patent: Nov. 13, 2018

(54) ELECTRIC CONNECTOR WITH A TERMINAL INTERFACE

(71) Applicant: Lear Corporation, Southfield, MI (US)

(72) Inventors: Michael Glick, Farmington Hills, MI (US); Bhupinder Rangi, Novi, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 719 days.

(21) Appl. No.: 14/618,444

(22) Filed: Feb. 10, 2015

(65) Prior Publication Data

US 2015/0333466 A1 Nov. 19, 2015

Related U.S. Application Data

(60) Provisional application No. 61/992,518, filed on May 13, 2014.

(51) Int. Cl.
*H01R 13/42* (2006.01)
*H01R 43/20* (2006.01)

(52) U.S. Cl.
CPC ..... *H01R 13/42* (2013.01); *H01R 43/20* (2013.01); *Y10T 29/4921* (2015.01); *Y10T 29/49208* (2015.01)

(58) Field of Classification Search
CPC ... H01R 13/111; H01R 13/113; H01R 13/114; H01R 13/42–13/4226; H01R 43/30; H01R 43/20; H01R 43/22; Y10T 29/49208
See application file for complete search history.

(56) References Cited

U.S. PATENT DOCUMENTS 3,699,502 A * 10/1972 Carter ..... H01R 13/428 439/499
4,040,713 A 8/1977 Könnemann
4,540,234 A 9/1985 Könnemann et al.
4,540,235 A 9/1985 Lolic
4,583,812 A 4/1986 Gross, Jr. et al.
4,932,877 A 6/1990 Zinn
5,007,865 A 4/1991 Jakobeit
5,064,379 A 11/1991 Ryll et al.
5,080,604 A 1/1992 Rider et al.
(Continued)

FOREIGN PATENT DOCUMENTS

CN 202094365 U 12/2011
CN 103996918 A 8/2014
(Continued)

OTHER PUBLICATIONS

PCT International Search Report and the Written Opinion, Application No. PCT/US2013/065900 filed Oct. 21, 2013, dated Feb. 12, 2014.

*Primary Examiner* — Livius R Cazan
(74) *Attorney, Agent, or Firm* — MacMillan, Sobanski & Todd, LLC

(57) ABSTRACT

A method of assembling an electrical connector includes inserting an electric terminal with an attached wire to an initially inserted position in a wire opening defined by a connector body. The electric terminal is moved through the wire opening in an insertion direction relative to the connector body. The electric terminal is attached to the connector body in a seated position, wherein the wire is coaxial with the wire opening.

11 Claims, 6 Drawing Sheets

(56) References Cited

U.S. PATENT DOCUMENTS

| | | | |
|---|---|---|---|
| 5,147,230 | A | 9/1992 | Plyler et al. |
| 5,334,058 | A | 8/1994 | Hotea |
| 5,413,506 | A | 5/1995 | Thompson |
| 5,415,571 | A | 5/1995 | Lutsch |
| 5,437,566 | A | 8/1995 | Zinn et al. |
| 5,558,547 | A | 9/1996 | Breitschaft et al. |
| 5,573,434 | A | 11/1996 | Ittah et al. |
| 5,616,717 | A | 4/1997 | Grozinger |
| 5,654,972 | A | 8/1997 | Kuroiwa et al. |
| 5,664,972 | A | 9/1997 | Zinn et al. |
| 5,755,599 | A | 5/1998 | Hotea |
| 5,868,590 | A | 2/1999 | Dobbelaere |
| 5,941,740 | A | 8/1999 | Neuer et al. |
| 5,975,964 | A | 11/1999 | Seko et al. |
| 5,993,253 | A | 11/1999 | Sai |
| 6,224,428 | B1 | 5/2001 | Chen et al. |
| 6,402,571 | B1 | 6/2002 | Muller et al. |
| 6,475,040 | B1 | 11/2002 | Myer et al. |
| 7,252,559 | B1 | 8/2007 | Morello et al. |
| 7,278,891 | B2 | 10/2007 | Cvasa et al. |
| 7,556,542 | B2 | 7/2009 | Lischeck et al. |
| 7,578,694 | B2 | 8/2009 | Takahashi et al. |
| 7,766,706 | B2 | 8/2010 | Kawamura et al. |
| 7,892,050 | B2 | 2/2011 | Pavlovic et al. |
| 7,988,481 | B2 | 8/2011 | Bethurum et al. |
| 8,057,261 | B1 | 11/2011 | DeSio et al. |
| 8,282,426 | B2 | 10/2012 | Zweigle |
| 8,339,235 | B2 | 12/2012 | Beckert et al. |
| 8,366,497 | B2 | 2/2013 | Glick et al. |
| 8,475,220 | B2 | 7/2013 | Glick et al. |
| 8,678,867 | B2 | 3/2014 | Glick et al. |
| 2001/0019924 | A1 | 9/2001 | Heimueller |
| 2003/0067242 | A1 | 4/2003 | Konishi et al. |
| 2006/0040555 | A1 | 2/2006 | Chen et al. |
| 2010/0311280 | A1 | 12/2010 | Tin et al. |
| 2011/0177722 | A1* | 7/2011 | Casses ..... H01R 4/184 439/660 |
| 2012/0129407 | A1 | 5/2012 | Glick et al. |
| 2013/0045630 | A1 | 2/2013 | Natter |
| 2013/0090009 | A1 | 4/2013 | Zhao |
| 2013/0130530 | A1 | 5/2013 | Casses et al. |
| 2013/0330968 | A1 | 12/2013 | Duan |
| 2014/0235113 | A1 | 8/2014 | Glick et al. |

FOREIGN PATENT DOCUMENTS

| | | | |
|---|---|---|---|
| DE | 10019241 | A1 | 10/2001 |
| DE | 69934065 | T2 | 6/2007 |
| DE | 10021972 | B4 | 3/2009 |
| DE | 19961544 | B4 | 3/2009 |
| EP | 0282624 | A2 | 9/1988 |
| GB | 2323221 | A | 9/1998 |
| JP | 10125378 | A | 5/1998 |
| JP | 2011238399 | A | 11/2011 |
| WO | 1989/05531 | A1 | 6/1989 |
| WO | 2014/063142 | A1 | 4/2014 |

* cited by examiner

ELECTRIC CONNECTOR WITH A TERMINAL INTERFACE

CROSS-REFERENCE TO RELATED APPLICATIONS

This application claims the benefit of U.S. Provisional Application No. 61/992,518, filed May 13, 2014, the disclosure of which is incorporated herein by reference.

BACKGROUND OF THE INVENTION

This invention relates in general to an electric connector. More specifically, this invention relates to a terminal interface for a right angle electric connector.

Electric connectors are used in a variety of situations where it is desirable to have an electric connection between components. For example, electric connectors are used to complete electrical circuits with components in a power distribution box or to connect a wiring harness to an electrical device. These electric connectors may include a wire that is connected to a connector terminal. The connector terminal is designed to mate with a corresponding terminal located, for example, in the power distribution box. Some electric connectors include a connector terminal that mates with the corresponding terminal on a first axis, while the wire exits the connector on a second axis that is perpendicular to the first axis. These are known as right angle connectors or ninety-degree connectors because there is a ninety-degree angle between the terminal and the wire of the connector.

The wire is commonly connected to the connector terminal by crimping an end of the wire to a portion of the connector terminal. This crimping helps maintain a good connection between the wire and the connector terminal. The connector terminal is typically fixed inside a connector body in order to help prevent damage to the electric connector and to maintain proper mating between the connector terminal and the corresponding terminal. For example, the connector terminal should not pull out of the connector body if the wire is tugged or pulled. Assembling these electric connectors can require inserting the wire end through a wire opening in the connector body prior to crimping the wire end to the connector terminal. It would be advantageous to have an electric connector that is easier to assemble.

SUMMARY OF THE INVENTION

This invention relates to a method of assembling an electrical connector. The method includes inserting an electric terminal with an attached wire to an initially inserted position in a wire opening defined by a connector body. The electric terminal is moved through the wire opening in an insertion direction relative to the connector body. The electric terminal is attached to the connector body in a seated position, wherein the wire is coaxial with the wire opening.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
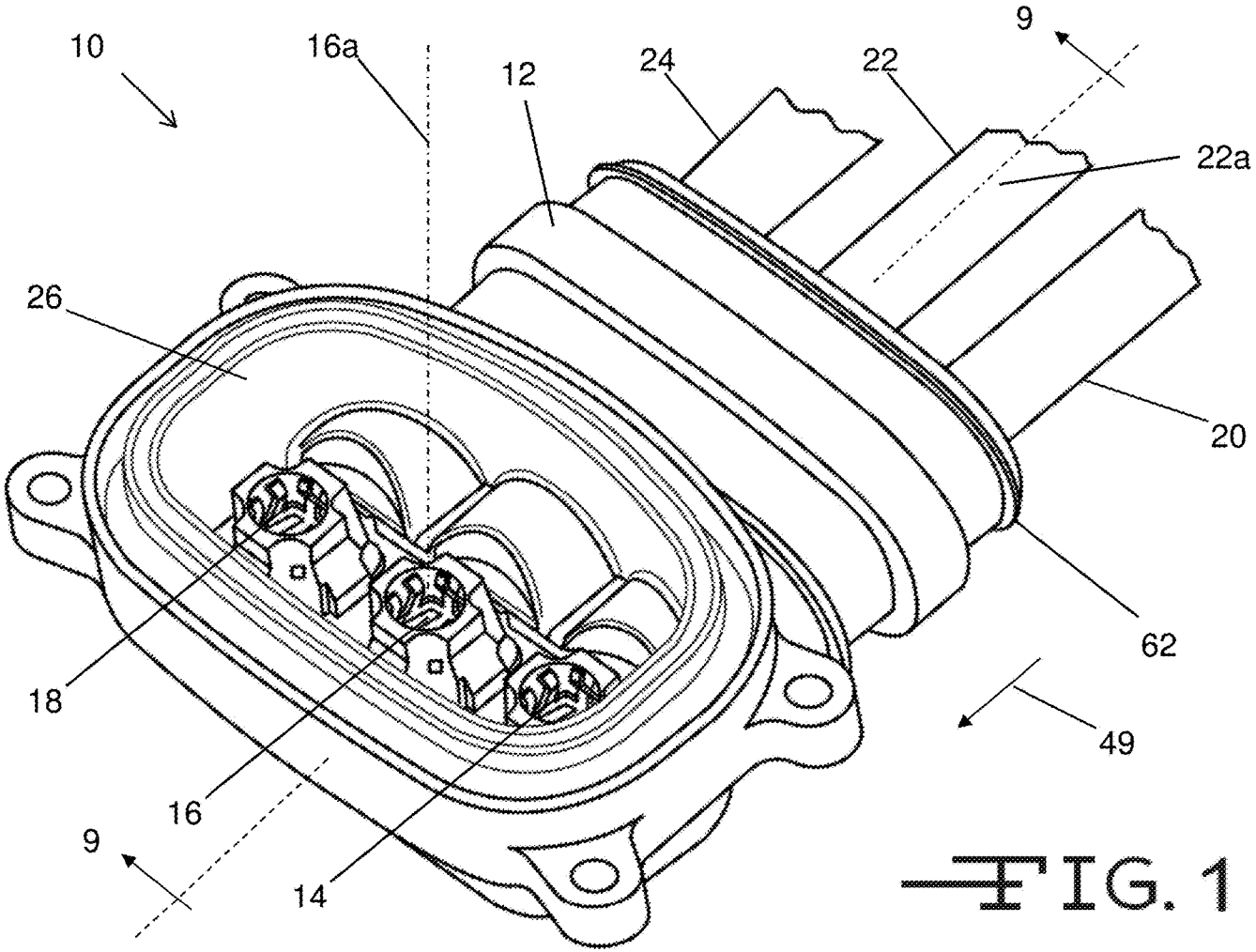
FIG. 1 is a perspective view of an electric connector.

Referring now to the drawings, there is illustrated in FIG. 1 a perspective view of an electric connector, indicated generally at 10. The electric connector 10 includes a connector body 12. The illustrated connector body 12 is made of aluminum, but may be made of any desired material. The electric connector 10 includes three electric terminals 14, 16, and 18 that are connected to respective insulated wires 20, 22, and 24. The electric connector 10 includes a terminal retainer 26 that is attached to the connector body 12 in order to retain the electric terminals 14, 16, and 18 in place and to protect the electric terminals 14, 16, and 18. The illustrated terminal retainer 26 is made of plastic, but may be made of any desired material.

Figure 2:
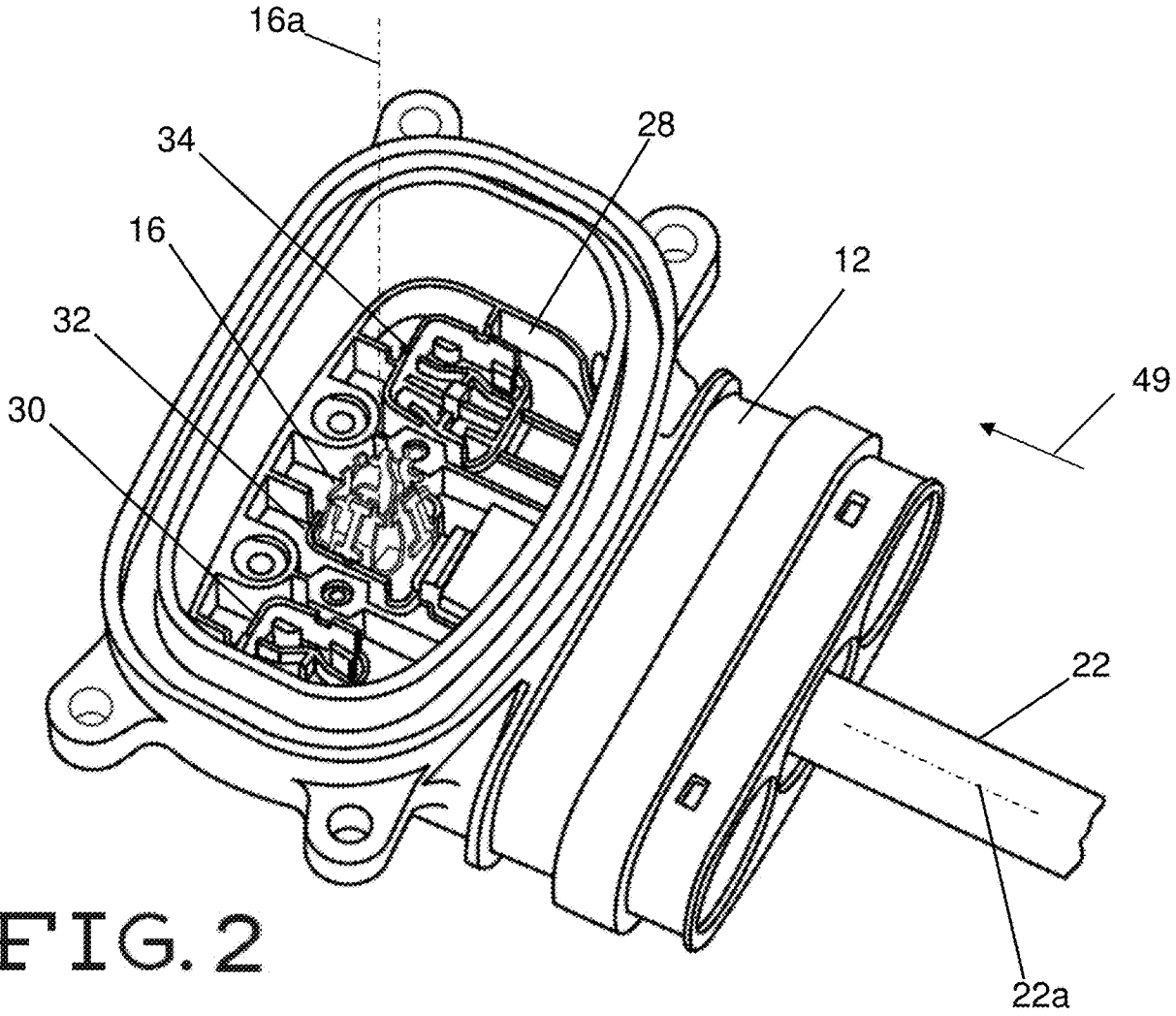
FIG. 2 is a perspective view of the electric connector of FIG. 1 shown only partially-assembled, with only one electric terminal inserted in a connector body.

Referring now to FIG. 2, a perspective view similar to that of FIG. 1 is shown, with the electric connector 10 only partially-assembled. As illustrated in FIG. 2, the terminal retainer 26 is not installed on the connector body 12 and only one electric terminal 16 is shown. The electric connector 10 includes a terminal interface 28 connected to the connector body 12. The terminal interface 28 may be held in place in the connector body 12 by a press fit or any desired fastener. The illustrated terminal interface 28 is made of plastic, but may be made of any desired material. The terminal interface 28 includes three cradles 30, 32, and 34. When the electric connector 10 is assembled, the electric terminals 14, 16, and 18 are mounted on the respective cradles 30, 32, and 34, as will be described in detail below. The illustrated electric terminal 16 is a female-type terminal, but it should be appreciated that the electric terminals 14, 16, and 18 may be any desired type of terminal. Additionally, it should be appreciated that the electric connector 10 may include any desired number of electric terminals.

The electric terminal 16 is oriented to engage a corresponding terminal (not shown) that mates with the electric terminal 16 along a terminal axis 16*a*. The wire 22 connected to the terminal extends from the connector body 12 along a wire axis 22*a*. The terminal axis 16*a* and the wire axis 22*a* are substantially perpendicular, and the electric connector 10 is a right-angle connector.

Figure 3:
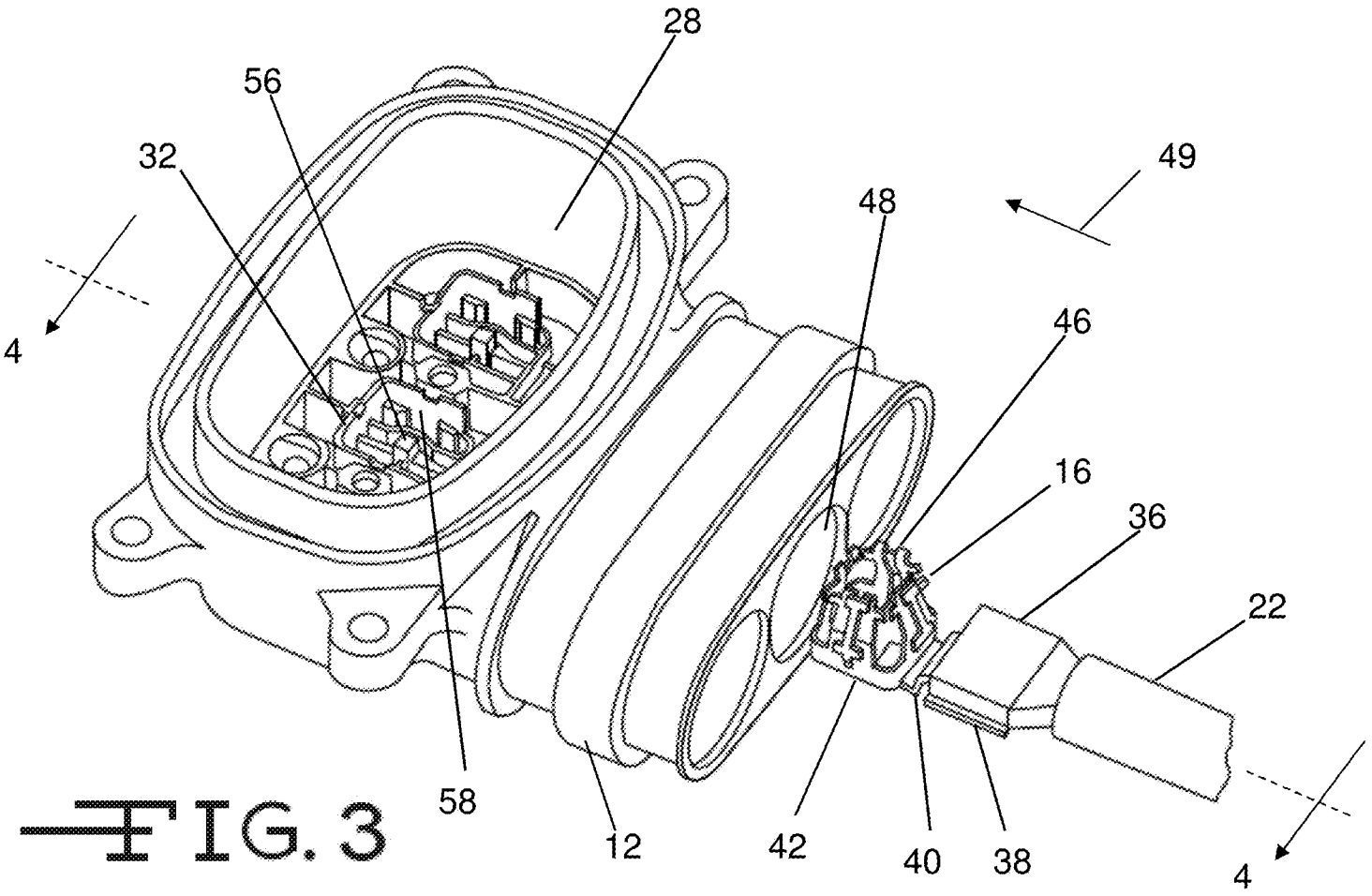
FIG. 3 is an exploded perspective view similar to FIG. 2, with the electric terminal shown prior to installation.

Referring now to FIG. 3, there is shown a perspective view of the connector body 12 and the electric terminal 16, prior to the electric terminal 16 being installed on the connector body 12. The wire 22 includes an exposed portion 36 where the conductive core of the wire 22 is attached to the electric terminal 16. The illustrated exposed portion 36 of the wire 22 is welded to a termination portion 38 of the electric terminal 16. However, the exposed portion 36 of the wire 22 may be attached to the electric terminal 16 using any desired fastener or method.

Figure 4:
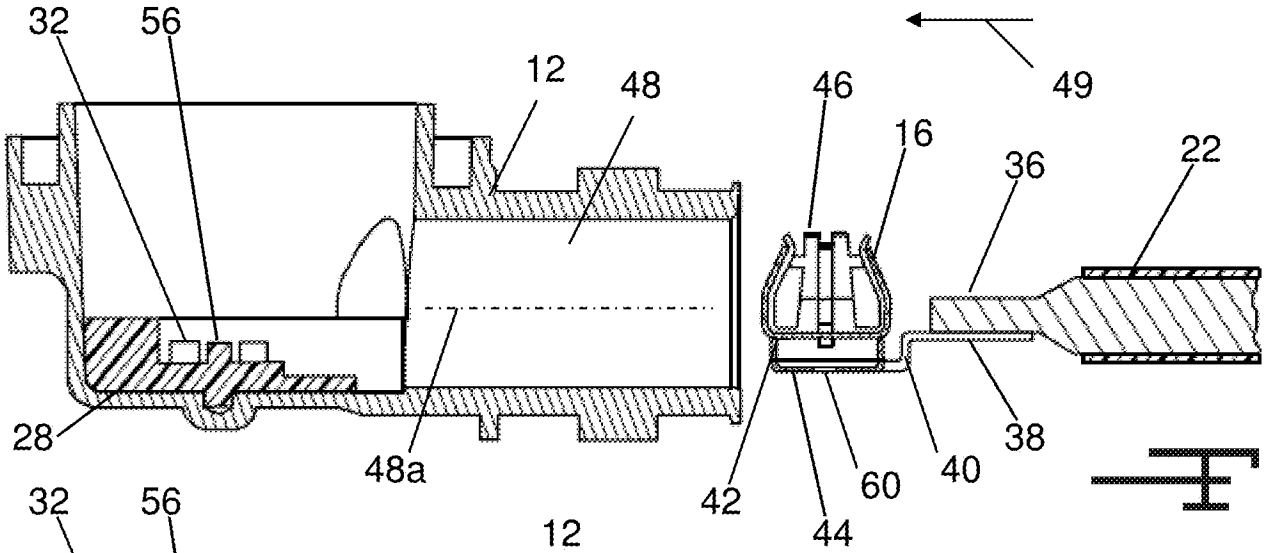
FIG. 4 is a cross-sectional view taken along line 4-4 of FIG. 3.

As best seen in FIG. 4, the electric terminal 16 includes a termination offset 40. The illustrated termination offset 40 is a bend located between the termination portion 38 and a body 42 of the electric terminal 16. The termination offset 40 moves the termination portion 38 away from a rear end 44 of the electric terminal 16, and toward a front end 46 of the electric terminal 16. It should be appreciated that this also moves the wire axis 22*a* of the connected wire 22 away from the rear end 44 and toward the front end 46 of the electric terminal 16. The significance of the termination offset 40 will be explained below.

Figure 5:
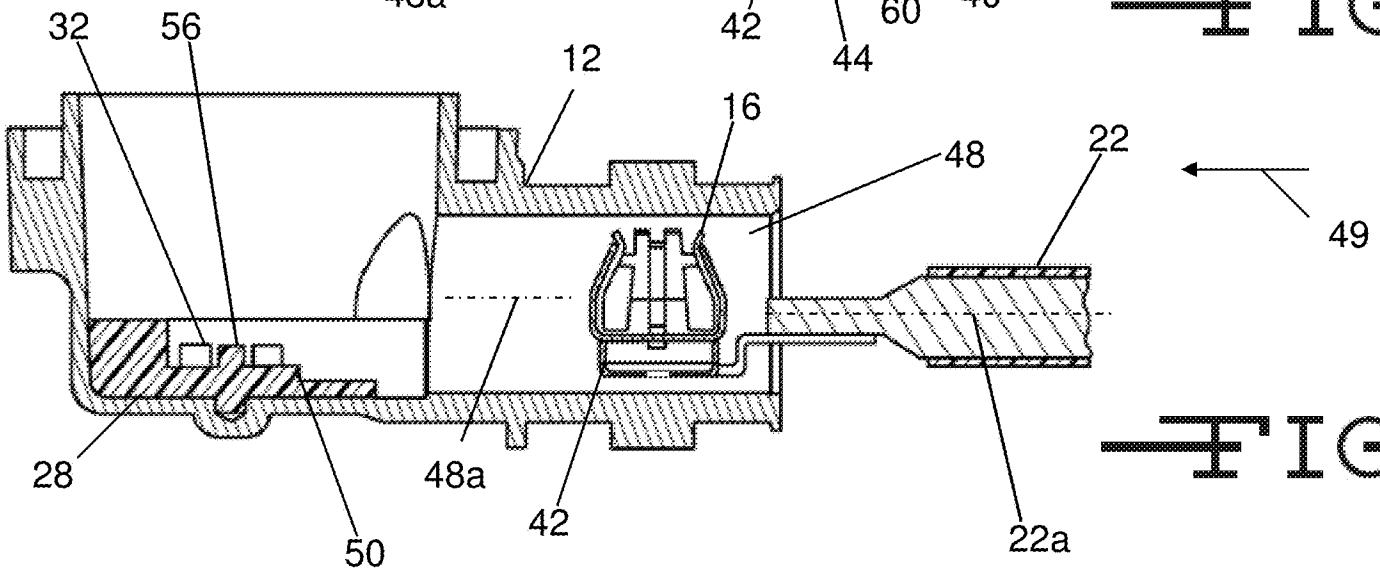
FIG. 5 is a cross-sectional view similar to FIG. 4, showing the electric terminal initially inserted into a wire opening of the connector body.

Referring now to FIG. 5, the electric terminal 16 is shown in an initially inserted position in a wire opening 48 defined by the connector body 12. The illustrated wire opening 48 has a circular cross-sectional shape, but may have any desired shape. The illustrated circular shape is advantageous for sealing the wire opening 48 when the electrical connector is assembled, as will be described below. The illustrated wire opening 48 is large enough to accommodate body 42 of the electric terminal 16 with minimal clearance.

Figure 6:
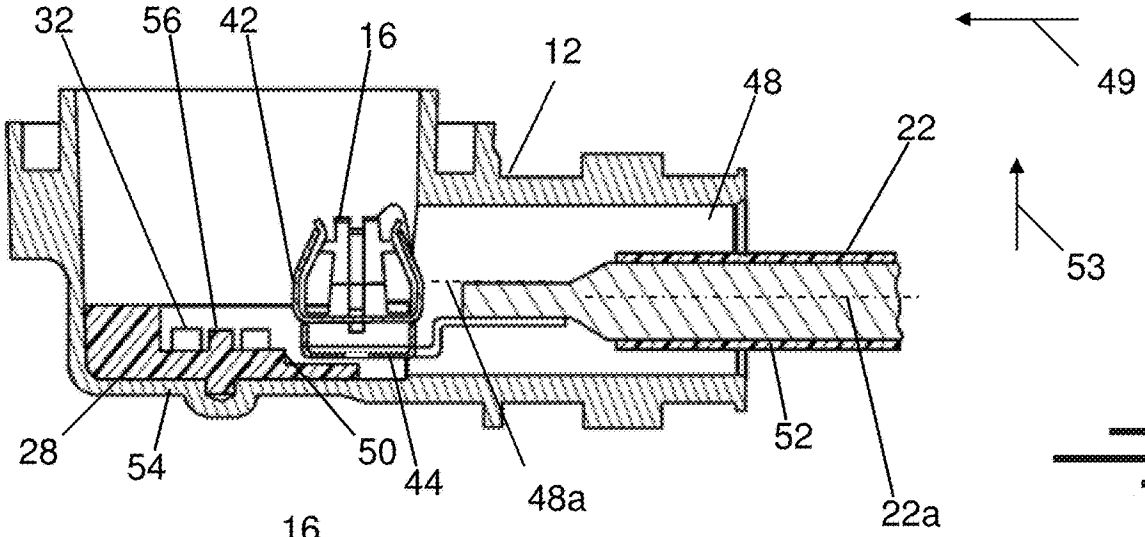
FIG. 6 is a cross-sectional view similar to FIG. 5, showing the electric terminal positioned over a cradle of a terminal interface attached to the connector body.

Referring to FIG. 6, the electric terminal 16 is shown moved in an insertion direction 49 relative to the connector body 12 farther into the wire opening 48. The illustrated insertion direction is parallel to the wire axis 22*a*. The body 42 of the electric terminal 16 is shown passed through the wire opening 48 and almost engaged with a leading edge 50 of the terminal interface 28. As shown, the wire axis 22*a* is located on a first side of a wire opening axis 48*a*. In the illustrated embodiment, the termination offset 40 positions the wire 22 so that an outer wire surface 52 is substantially aligned with the rear end 44 of the electric terminal 16. However, the termination offset 40 may position the outer wire surface 52 in any desired position relative to the electric terminal 16. It should be appreciated that if the wire 22 has a large enough diameter, the outer wire surface 52 may engage the connector body 12 rather than move easily through the wire opening 48. In that case, the termination offset 40 may be used to provide a space between the outer wire surface 52 and the connector body 12. Otherwise, it may be necessary to provide a wider wire opening 48 in order to accommodate the electric terminal 16 and the connected wire 22, which would increase the size of the connector body 12.

Figure 7:
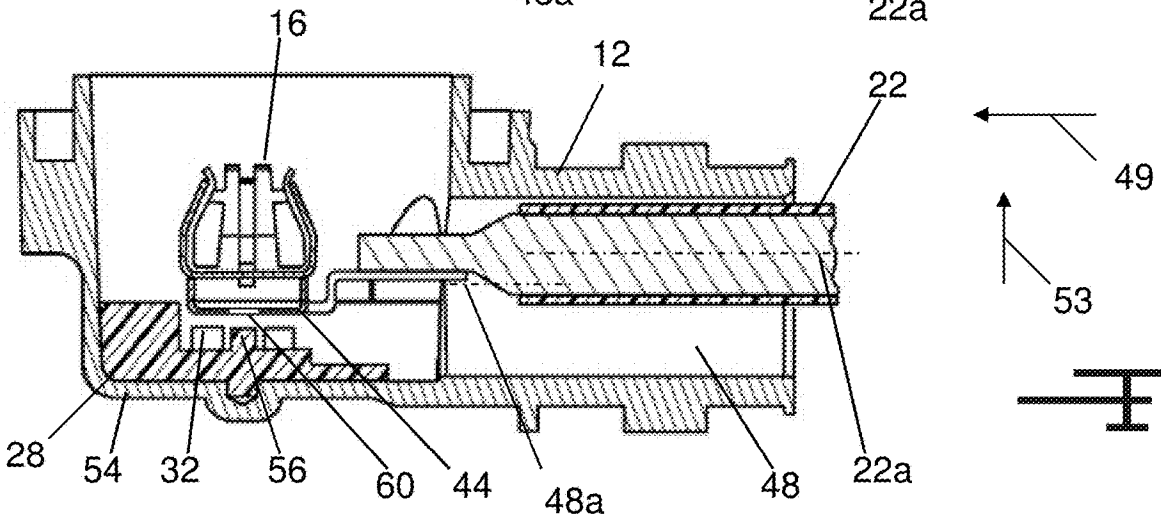
FIG. 7 is a cross-sectional view similar to FIG. 6, showing the electric terminal positioned over a cradle on the connector body.

Referring now to FIG. 7, the electric terminal 16 is shown positioned over the cradle 32 of the terminal interface 28. It should be appreciated that when the body 42 of the electric terminal 16 is no longer within the wire opening 48, the rear end 44 of the electric terminal 16 may be moved in a seat direction 53, away from a rear wall 54 of the connector body 12. The illustrated seat direction 53 is perpendicular to the insertion direction 49 and is parallel to the terminal axis 16*a* of the electric terminal 16. As shown, the wire 22 is moved in the seat direction 53 within the wire opening 48 so that the wire axis 22*a* is now on a second side of the wire opening axis 48*a*.

Figure 8:
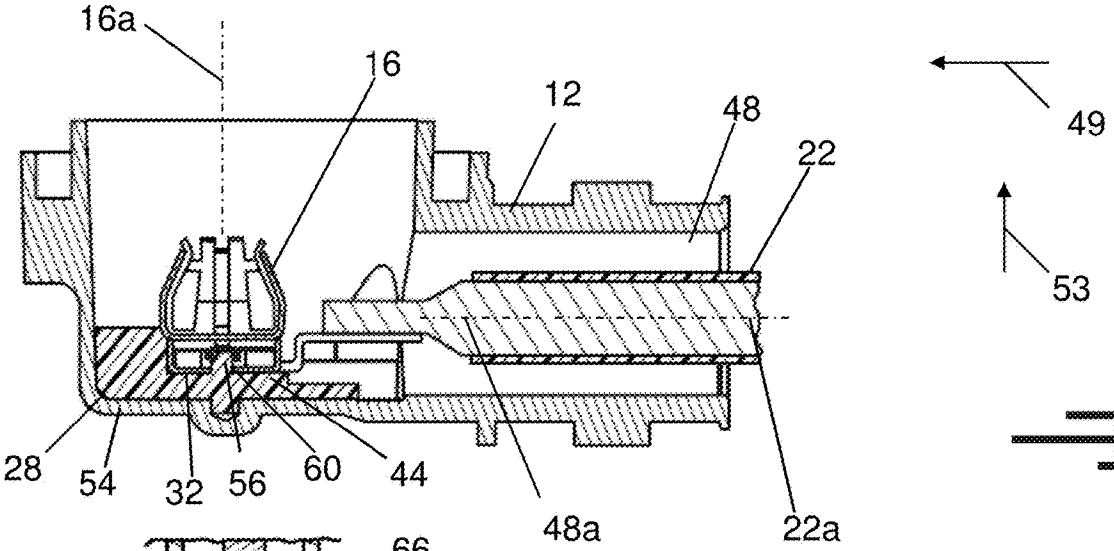
FIG. 8 is a cross-sectional view similar to FIG. 7, showing the electric terminal seated on the cradle.

Referring now to FIG. 8, the electric terminal 16 has been moved in the direction opposite the seat direction 53 so that the rear end 44 has engaged the terminal interface 28 and the electric terminal 16 is shown in a seated position on the cradle 32. The cradle 32 serves to properly position the electric terminal 16 relative to the connector body 12. The illustrated cradle 32 includes a positioning post 56 and side walls 58 (best seen in FIG. 3). The positioning post 56 is inserted into a positioning hole 60 defined by the electric terminal 16, while the side walls 58 engage the body 42 of the electric terminal 16. It should be appreciated that the cradle 32 may have any other desired cooperating features engage the electric terminal 16 in order to position the electric terminal 16 relative to the connector body. With the electric terminal 16 seated on the cradle 32, the wire 22 is located in the center of the wire opening 48, and the wire axis 22*a* is coaxial with the wire opening axis 48*a*.

Figure 9:
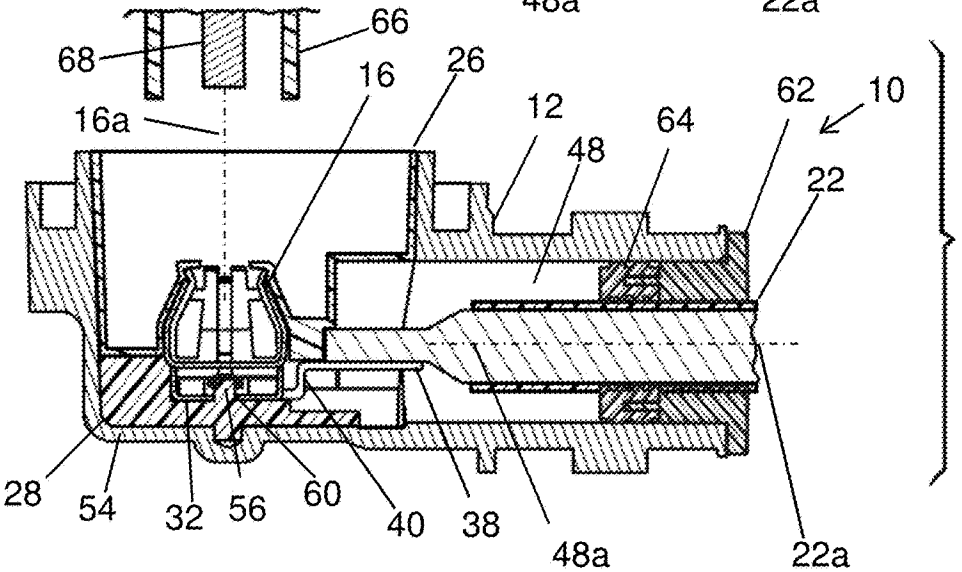
FIG. 9 is a cross-sectional view similar to FIG. 8, showing the electric connector with a terminal retainer and wire seal installed taken along line 9-9 of FIG. 1.

Referring to FIG. 9, a cross-sectional view taken along line 9-9 of FIG. 1 is shown. FIG. 9 illustrates the fully-assembled electric connector 10, and it should be appreciated that electric terminals 14 and 18 have been installed in a manner similar to that previously described for electric terminal 16. An end cap 62 has been press fit onto the connector body 12. The illustrated end cap 62 is made of plastic, but may be made of any desired material. The end cap 62 includes an attached wire opening seal 64. The illustrated wire opening seal 64 is a rubber O-ring that is located in the wire opening 48 and engages the wire 22. The circular cross-sectional shape of the wire opening 48 is advantageous in that is allows a rubber O-ring to be used as the wire opening seal 64. However, the wire opening seal 64 may be made of other materials or have any other desired shape. Also shown in FIG. 9, the terminal retainer 26 has been connected to the connector body 12. A corresponding electric connector 66 is also shown. The corresponding electric connector 66 includes a male pin terminal 68 which is the corresponding terminal that electric terminal 16 is adapted to mate with.

It should be appreciated that the electrical connector 10 described may be assembled by connecting the electric terminal 16 to the wire 22 prior to inserting the wire 22 into the wire opening 48. Further, depending on the size of the wire 22, the termination offset 40 may allow the size of the wire opening 48 to be reduced, which allows the size of the electrical connector 10 to be reduced.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A method of assembling an electric connector, comprising the steps of:

inserting an electric terminal with an attached wire that defines a wire axis to an initially inserted position in a wire opening in a connector body that defines a wire opening axis;

initially moving the electric terminal in an insertion direction relative to the connector body through the wire opening within the connector body such that the wire axis is not coaxial with the wire opening axis;

subsequently moving the electric terminal relative to the connector body to a seated position, wherein the wire axis is coaxial with the wire opening axis; and attaching the electric terminal to the connector body to form an electric connector;

wherein the step of subsequently moving the electric terminal relative to the seated position is performed by moving the electric terminal in a seat direction that is parallel to a terminal axis of the electric terminal; and wherein the seat direction is perpendicular to the insertion direction.

2. The method of assembling an electric connector of claim 1, wherein the electric terminal is a female electric terminal.

3. The method of assembling an electric connector of claim 1, wherein the electric connector is a right-angle connector.

4. The method of assembling an electric connector of claim 1, further comprising, after moving the electric terminal in a seat direction relative to the connector body and before attaching the electric terminal to the connector body in a seated position, the step of moving the electric terminal further in the insertion direction relative to the connector body.

5. The method of assembling an electric connector of claim 4, further comprising, after moving the electric terminal further in the insertion direction relative to the connector body and before attaching the electric terminal to the connector body, the step of moving the electric terminal in the direction opposite the seat direction relative to the connector body.

6. The method of assembling an electric connector of claim 1, wherein the wire is inserted into the wire opening after the electric terminal.

7. The method of assembling an electric connector of claim 1, wherein attaching the electric terminal to the connector body in a seated position includes inserting a positioning post on the connector body into a positioning hole defined by the electric terminal.

8. The method of assembling an electric connector of claim 1, wherein when the electric terminal is in the seated position, the electric terminal is located on a cradle on the connector body.

9. The method of assembling an electric connector of claim 8, wherein the cradle includes cooperating features to position the electric terminal relative to the connector body.

10. The method of assembling an electric connector of claim 1, wherein the terminal includes a termination offset that positions the wire so that it is coaxial with the wire opening.

11. The method of assembling an electric connector of claim 10, wherein the termination offset is a bend in the electric terminal in a direction parallel to a terminal axis of the electric terminal.

* * * * *